United States Patent [19]

Welsh

[11] Patent Number: 4,738,244

[45] Date of Patent: Apr. 19, 1988

[54] LOW AIR VOLUME KITCHEN EXHAUST HOOD

[75] Inventor: Clarke T. Welsh, Logansport, Ind.

[73] Assignee: LDI Mfg. Co., Inc., Logansport, Ind.

[21] Appl. No.: 15,155

[22] Filed: Feb. 17, 1987

[51] Int. Cl.[4] ..... F24C 15/20

[52] U.S. Cl. ..... 126/299 R; 126/299 D; 55/DIG. 36

[58] Field of Search ..... 126/299 R, 299 D, 299 F, 126/300; 98/115.1, 115.2; 55/DIG. 36

[56] References Cited

U.S. PATENT DOCUMENTS

| | | | |
|---|---|---|---|
| 1,174,851 | 3/1916 | Gloekler et al. | 126/299 D |
| 1,895,371 | 1/1933 | Briegel | 126/299 D |
| 2,528,844 | 11/1950 | Robertson | 126/299 D |
| 3,295,433 | 1/1967 | Fox et al. | 126/299 D |
| 3,457,850 | 7/1969 | Sweet et al. | 126/299 R |
| 3,890,887 | 6/1975 | Kaufman et al. | 126/299 R |
| 3,980,072 | 9/1976 | Jacobs | 126/299 D |
| 4,089,327 | 5/1978 | Welsh | 126/299 D |
| 4,200,087 | 4/1980 | Welsh | 126/299 R |
| 4,462,387 | 7/1984 | Welsh | 126/299 R |

FOREIGN PATENT DOCUMENTS

| | | | |
|---|---|---|---|
| 142651 | 7/1980 | German Democratic Rep. | 126/299 D |

*Primary Examiner*—James C. Yeung
*Attorney, Agent, or Firm*—Woodard, Emhardt, Naughton, Moriarty & McNett

[57] ABSTRACT

An exhaust-only type of kitchen exhaust hood is provided with removable fume-guide plate upstream of the in-hood grease filters. The plates are shaped to provide a forward flow of fumes from the rear of the hood forward over the cooking unit toward the front lip of the hood. A slot is provided between the front edge of the plate and the front wall of the hood whereby the air flow into the hood accelerates around the front edge of the plates to provide a flow rate of approximately 200 feet per minute at the front edge of the hood. Slots are provided between the hood ends and adjacent side edges of plates next to the ends. The plates are movable to facilitate changing of filters.

31 Claims, 5 Drawing Sheets

LOW AIR VOLUME KITCHEN EXHAUST HOOD

BACKGROUND OF THE INVENTION

This invention relates generally to exhaust hoods, and more particularly to kitchen exhaust hoods which do not have any built-in make-up air provisions.

It is possible to identify two major categories of kitchen exhaust hoods. Those in one category, hereinafter sometimes referred to as "exhaust-only" hoods, take air and fumes from over the cooking unit and exhaust it through the hood to the exterior of the building, thus removing heat and fumes from the area around the cooking unit. The hoods in the second category, hereinafter sometimes referred to as "make-up air" hoods, in addition to removing air from above the cooking equipment, introduce fresh air from outside the building to make up (at least partially) for that which is exhausted.

The disadvantage in use of exhaust-only hoods has been the fact that, due to relatively poor performance of some such hoods, it has been necessary to exhaust large volumes of air in order to be certain that all of the combustion products and fumes from the cooking unit are removed. The problem is that air must be taken from the kitchen to make up for the air that has been exhausted from the hood. At locations and during periods of the year when it is necessary to heat or cool room air for the comfort of the occupants, a significant amount of energy is used in either heating or cooling the room air and attempting to control the temperature thereof. So it is undesirable to have this "tempered" air removed from the building by the kitchen exhaust equipment.

To deal with this problem, hoods have been designed to provide their own make-up air. To do so, such hoods have air movers operating to bring air into the hood assembly from outdoors, in an amount comparable to that being exhausted. For example, in the hood disclosed in my U.S. Pat. No. 4,089,327 issued May 16, 1978, approximately 80% of the air that is exhausted is brought in by the make-up air mover in the hood. Higher percentages of make-up air can be used, if desired. In some such hoods, means have been used to introduce air from the hood into the room, other than directly to the area over the cooking surface. Examples are shown in the Sweet et al. U.S. Pat. No. 3,457,850 issued July 29, 1969, the Kaufman et al. U.S. Pat. No. 3,890,887 issued June 24, 1975, and the Jacobs U.S. Pat. No. 3,980,072 issued Sept. 14, 1976.

Make-up air hoods have shown significant advantages over the exhaust-only hoods, in terms of minimizing the impact of hood exhaust on the room environment, but there are some disadvantages to them. For example, because relatively large volumes of air are used, the blower sizes and power requirements are significant. In addition, the introduction of air requires a blower or blowers for that purpose, resulting in an installation that is or can be twice as expensive in terms of air moving equipment, as an exhaust-only hood. Also, it adds some complexity to the hood construction itself and the related ductwork and rooftop equipment. Therefore, there has remained a significant need for exhaust-only type hoods but with performance sufficiently high to permit the use of them with only a modest impact on the heating and cooling loads on the building environmental control equipment. The present invention meets this need.

My U.S. Pat. No. 4,200,087, issued Apr. 29, 1980, and U.S. Pat. No. 4,462,387, issued July 31, 1984, disclose inventions in the make-up air type of hood. The present invention is incorporated in an exhaust-only hood.

SUMMARY OF THE INVENTION

Described briefly, according to a typical embodiment of the present invention, an exhaust-only type of hood is provided with removable flow guide plates upstream of the in-hood grease filters. The plates are shaped to provide a forward flow of air from the rear of the hood forward over the cooking unit toward the front lip of the hood. A slot is provided between the front edges of the plates and the front wall of the hood whereby the air flow into the hood accelerates around the front edges of the baffle plates to provide a flow rate of approximately 200 feet per minute at the front edge of the hood. Apertures are provided in the plates, and apertures or slots are provided between the hood side curtains (end walls) and the plates. The plates are hinged or completely removable to facilitate changing of filters.

DESCRIPTION OF THE PREFERRED EMBODIMENT

Figure 1:
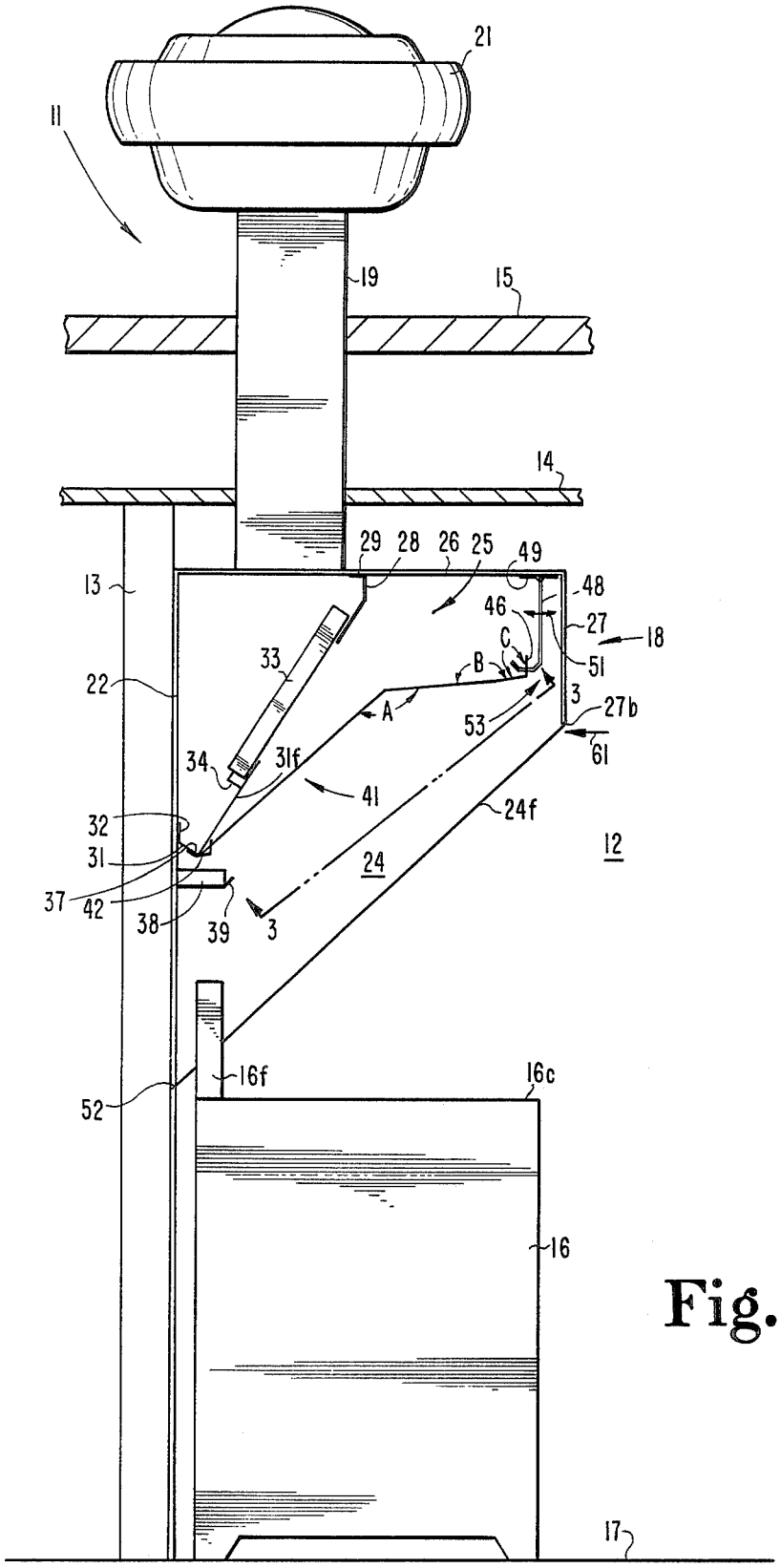
FIG. 1 is a fragmentary section through a building kitchen showing in section an exhaust apparatus according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, FIG. 1 shows a portion 11 of a building having kitchen 12 therein with a wall 13, suspended ceiling 14 and roof 15. A cooking unit 16 rests on the floor 17 in front of the wall 13. Hood 18 is fastened to the wall 13 and has an outlet duct 19 (typically rectangular) extending through the roof to the exhaust air handling blower 21.

The hood itself, typically of stainless steel construction, includes a back wall 22, left and right side walls 23 and 24, top 26 and front 27. An upper filter rack 28 has an upper flange 29 welded to the top 26, and extends from one end wall 23 to the other end wall 24. Lower filter rack 31 has flange 32 welded to the back wall 22, and extends from end 23 to end 24. In the illustrated example, the overall length of the hood from wall 23 to wall 24 is forty-two inches. Three conventional 12 inch high by 12 inch long grease filters 33 are mounted on the racks, being supported on the filter support tabs 34 welded to the lower support rack 31, with the filters resting on the inside face of the upper filter rack 28. Vertically extending mullions 36 extending from the upper rack 28 to the lower rack 31 and secured to them or to the end walls 23 and 24, respectively, frame the filter receiving opening at the ends of the hood.

The lower filter rack 31 has a plurality of holes (not shown) at the lowermost edge 37 thereof and spaced along the length thereof, to drain grease therefrom into a grease tray 38 mounted on the grease tray end brackets 39 welded to the end walls 23 and 24 of the hood.

According to the illustrated embodiment of the invention, a flow guide plate 41 is provided between the area above the cooking surface **16*c* of the cooking unit and the filters. The lower portion of this plate is supported on a pair of brackets 42 which are welded to the lower filter rack and extend through apertures 43 in the plate 41 adjacent the lower marginal edge 44 thereof. The brackets 42 are shaped so as to hold the lower edge 44 of plate 41 to the lower margin of the front face 31*f* of the lower filter rack 31, but still permit intentional removal and re-installation of the plate in connection with servicing the filters and, when installed, allow free flow of contaminated air to pass from above plate 41** into the grease filters.

An upturned flange 46 is provided at the front of the plate 41 and has a pair of apertures 47 therein. Each of these receives a hook 48 pivotally hanging from a metal strap 49 welded to the top 26. These hangers are thereby able to move back and forth in the direction of the arrows 51 to the extent needed to easily be received in the apertures 47 in the front flange 46 while nevertheless permitting the lower rear edge 44 of the plate to be snugly and fully received in the supports 42 and against the wall **31*f*. Accordingly, the front flange 46 is located from 2 inches to 4 inches, typically about 3.25 inches back from the hood front wall 27, and the lower merging 46*b* edge thereof is located 3½ inches above the lower edge 27*b* of the front wall 27** of the hood. This edge has an inwardly and upwardly turned lip approximately one inch high to provide a smooth edge of the hood at this location.

The hood side (end) walls 23 and 24 have downwardly inclined front edges such as **24*f* which extend down from the bottom lip of the front wall to a point 52 where they meet the hood rear wall 22 and which is at a level approximately equal to the level of the top of the cooking surface 16*c*. This is typically about thirty-six inches above the floor. The edge 27*b* is preferably from twenty-three inches to twenty-eight inches above the cooking surface 16*c*, while the height of the front wall 27 is approximately twelve inches. The overall width of the hood from front wall 27 to rear wall 22 is preferably thirty-one inches in this example. Since the plate 41 extends substantially the entire width of the inside of the hood at the walls 23 and 24, it cooperates with the filter racks, mullions, filters, hood top, front and end walls to define a sort of deceleration chamber 25 upstream of the filters. The plate substantially seals this deceleration chamber from the interior of the hood above the cook top so that virtually all of the air which is pulled from the hood and exhausted outside the building by blower 21 must pass through the slot 53 between the front edge 46 of plate 41, and the front wall 27 of the hood, into chamber 25**. This slot extends the full length of the hood which, in this example, is forty-two inches.

Figure 4:
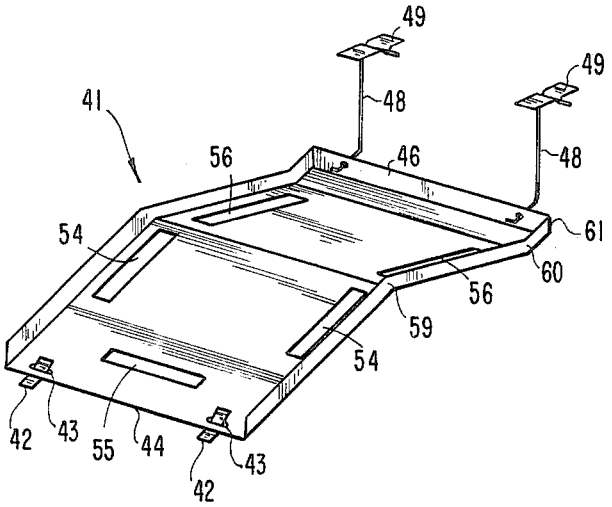
FIG. 4 is a pictorial view of the guide plate.

Five additional slots are provided. These are in the plate 41 itself. Two of the slots 54 are provided in the lower portion of the plate. A third slot 55 is also in the lower portion between and below slots 54. Two more of the slots 56 are provided in the intermediate portion of the plate. Slots 54 are approximately 3.75 inches high and 1 inch wide. Slot 55 is about 3 inches above edge 44 and is 1 inch high and 8 inches wide. Slots 56 are typically 5.62 inches high and 1 inch wide. They are located 1 inch in from the side ends 57 and 58 of the plate. At these ends there are upturned flanges as best shown in FIG. 4 which, being welded together such as at 59, 60 and at the corner 61 to the front flange 46, provide rigidity to the plate. Thus, an Angle A (FIG. 1) of 140° is maintained between the lower portion and intermediate portion. An angle B of 167° is maintained between the intermediate portion and forward portion. Similarly, an angle C of 105° is maintained between the forward portion and the flange 46. Then, upon installation of the plate in the hood as shown, the first portion is inclined upwardly and forwardly at an angle of approximately 42° above horizontal. The second portion is inclined upwardly and forwardly at a much slighter angle of approximately 2° above horizontal. The third portion is inclined upwardly and forwardly at an intermediate angle of approximately 15° above horizontal. Accordingly, in operation, fumes rising from the heating surface **16*c* are directed forwardly to the slot 53**. At that location, because of the relatively small area of the slot, the air velocity is much accelerated.

For air entering the hood at the face of front wall 27, it is preferable to have a velocity of approximately 200 lineal feet per minute along the length of the hood. This velocity should be achieved at the location of the lower front edge **27*b* of the hood for room air moving into the hood horizontally in the direction of the arrow 61 (FIG. 1) at that location. At the same time, air velocity vertically upward through slot 53 at the slot is approximately 400 lineal feet per minute. With the hood construction according to the present invention, this can be achieved at a volume of less than 150 cubic feet per minute, per foot length of hood, and still pass a standard methylene chloride test. The slots 54 and 56 are beneficial to prevent puffing of fumes from the space between the filters and the plate. Slot 55 permits much of the 1100° F. flue gas from the flue 16*f* of a gas cooking unit to pass through slot 55 without proceeding to slot 53, whereby virtually all of the capacity of slot 53 is utilized for cooking fumes, and relatively uniform velocity in the direction of arrow 61** is obtainable along the length of the hood. It is desirable, in terms of minimizing conditioned room air loss, to exhaust less than 125 cubic feet per minute per foot of hood length. The present invention makes this possible.

Figure 2:
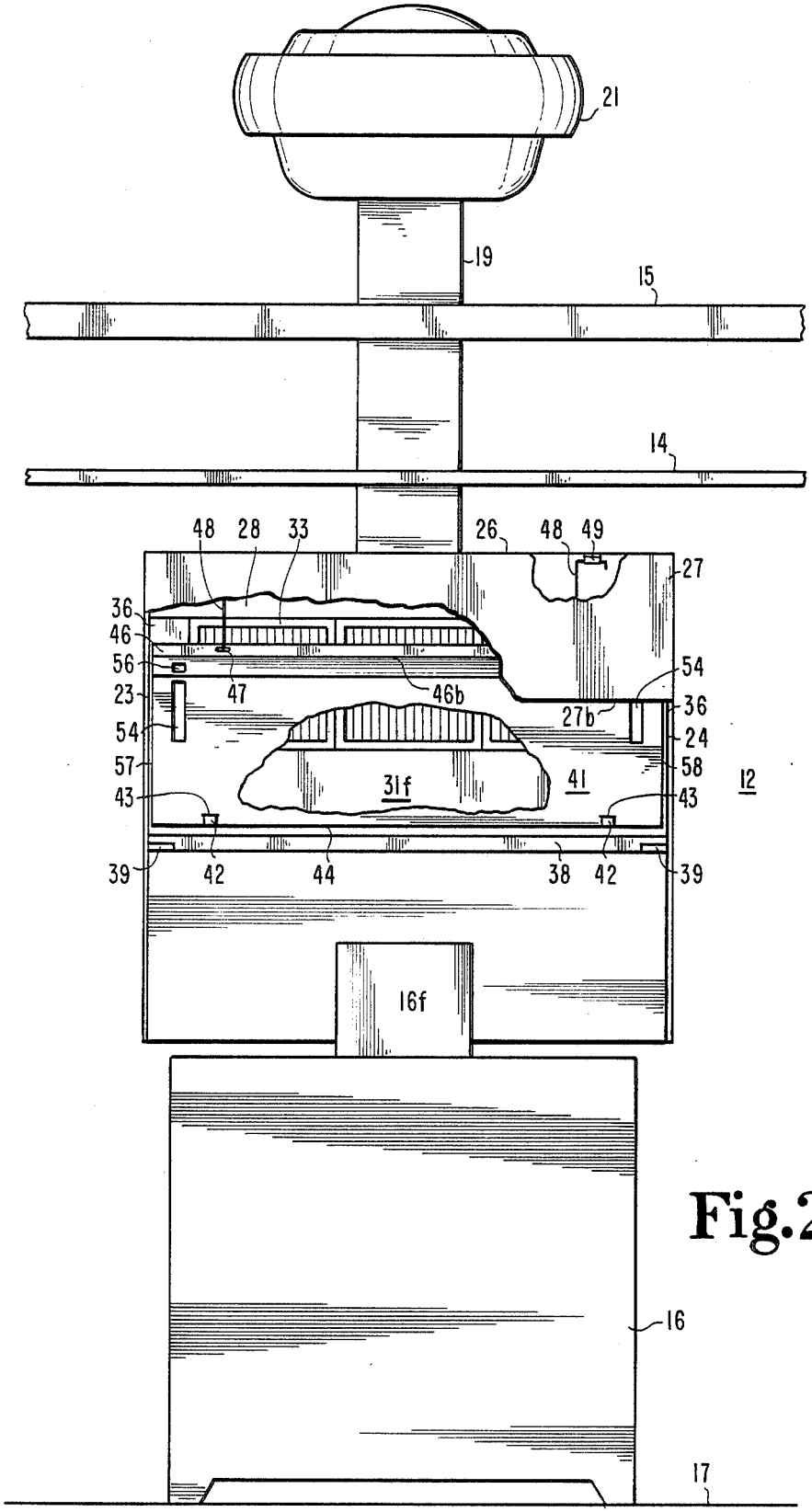
FIG. 2 is a front elevational view of an exhaust apparatus such as in FIG. 1.
Figure 3:
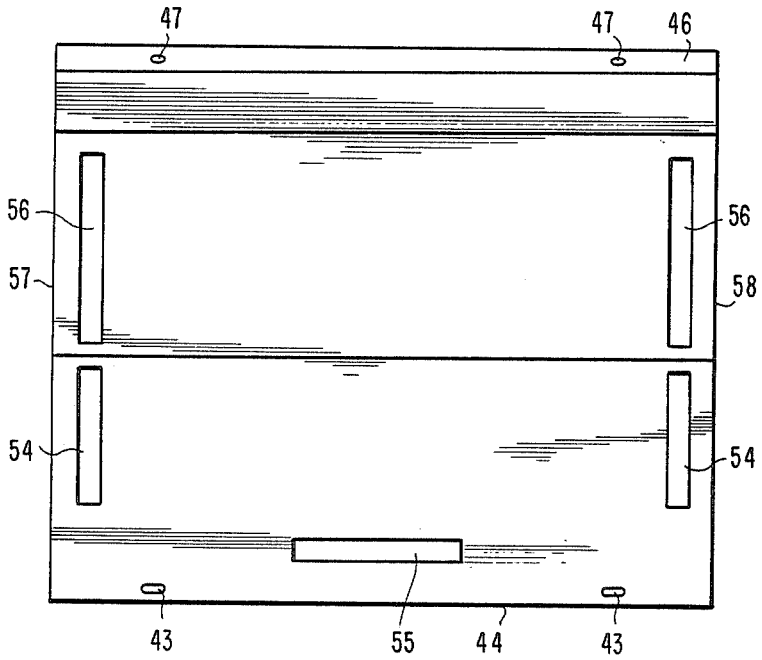
FIG. 3 is a view of one embodiment of a flow guide plate as it would look when viewed from line located as at 3—3 in FIG. 1 and looking in the direction of the arrows.
Figure 5:
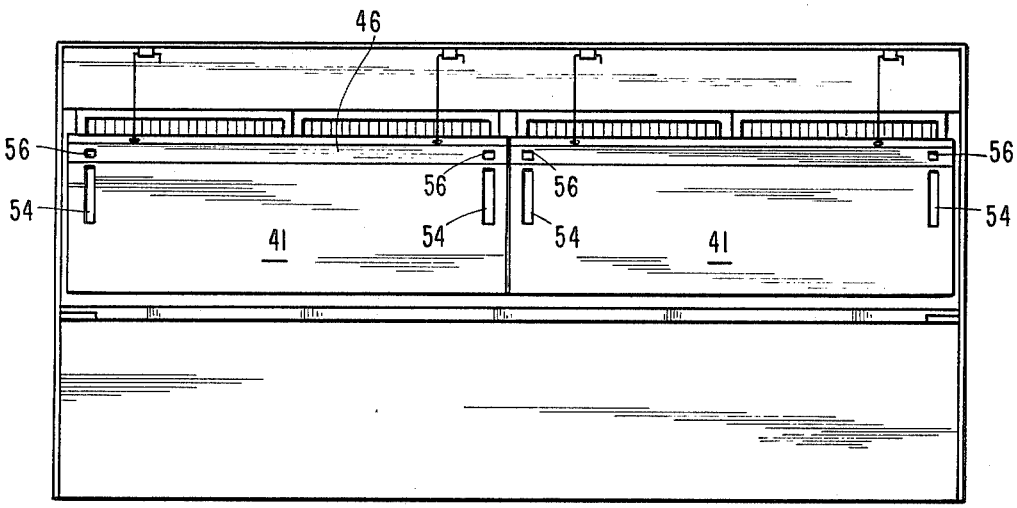
FIG. 5 is a front elevational view of a hood assembly showing two such guide plates as incorporated in a longer hood.

Referring now to FIG. 5, the illustrated example of the hood would be for an overall hood length of 84 inches. In this example, instead of using the 12 by 12 filters, four standard 12 by 20 inch filters would be used. Also, two of the plates 41 are used. The slots 54 and 56 are used, as before, and the slot 53 is the same width as in the example of FIGS. 1 and 2.

Figure 6:
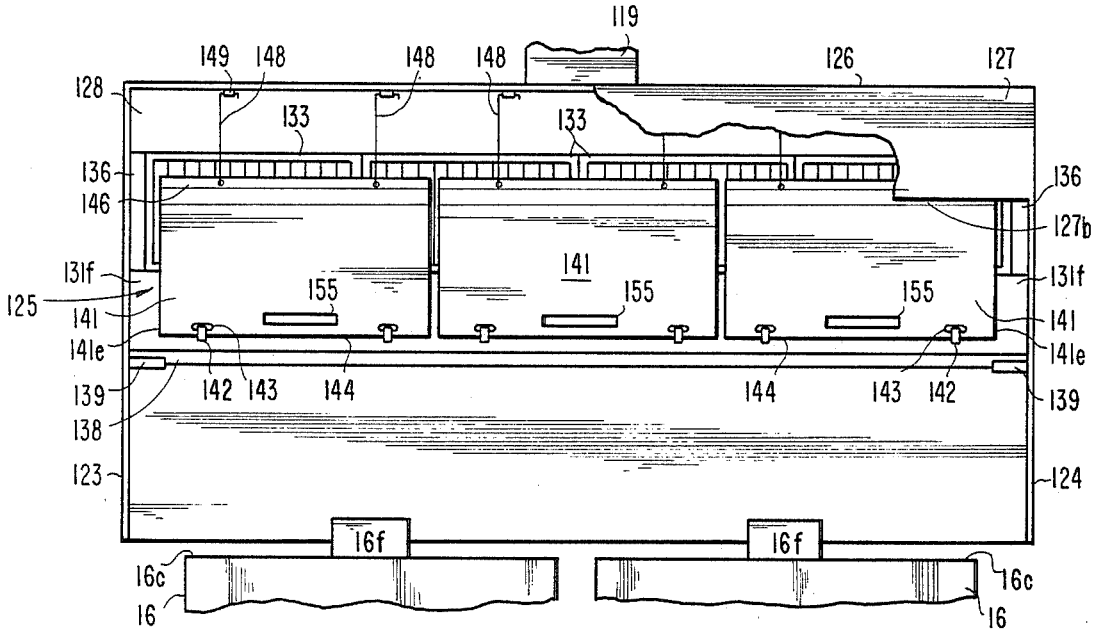
FIG. 6 is a fragmentary front elevational view of an exhaust apparatus such as in FIG. 1 with a preferred form of flow guide plate applied to a longer hood.
Figure 7:
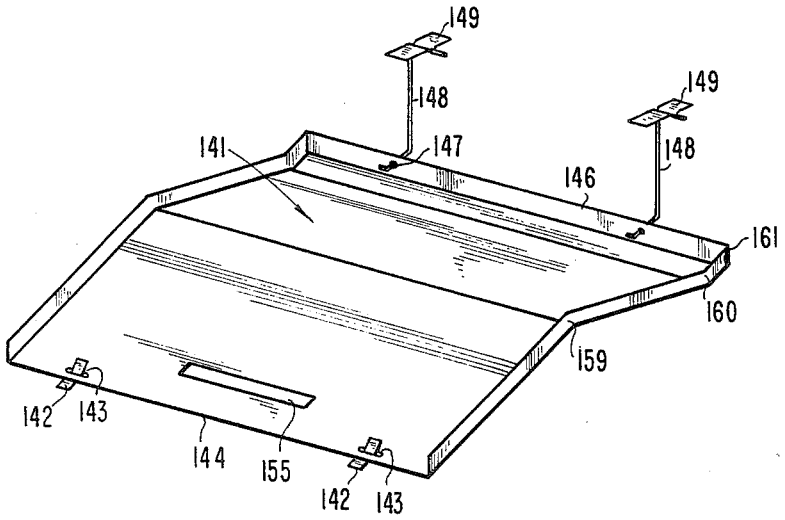
FIG. 7 is a pictorial view of the guide plate as used in the FIG. 6 embodiment of the invention.

Referring now to FIGS. 6 and 7, along with FIG. 1, the hood assembly shown in FIG. 6 should be understood to have the same configuration, when viewed from the end, as that in FIG. 1. Therefore, the various features are given the same reference numerals except with the added prefix digit "1". This example using three of the flow guide plates 141 could be for an eight foot or longer hood. Three plates ae used instead of two to limit the width of the plates to thirty inches so that, although made of 18 gauge stainless steel, they are conveniently light enough to unhook and remove, or swing down, to change filters 133.

In this embodiment of the invention, instead of using slots such as 54 and 56, the end plates are positioned with their sides 141*e* located three inches inboard from the hood end walls 123 and 124. This effectively provides a slot at each end of the hood for flow of fumes directly to the filter bank, similar to the effect of slot 53 at the front. Consequently, a peninsular slot of virtually uniform width is provided around three sides of the guide plate array within the hood and upstream of the filter bank. Thus, the high velocity with excellent clearing action is achieved entirely around the front and ends of the hood, despite the very low air volume exhausted. The edges of plates 141 which face adjacent plates are as close as possible to each other without interfering with removal or opening one with respect to another. The one inch by eight inch marginal slots 155 serve to vent flue gas from vents 16f of medium duty gas equipment. If desired, the upper edges of brackets 142 can be welded to the front wall 131*f* of the lower filter rack, to thereby close the hooks and effectively hinge the lower margins of the guide plates 141 to the filter rack. Then, by unhooking the hooks 148 from the holes 147, the plates 141 can swing downward from in front of the filters 133 to permit filter removal for cleaning, and replacement. As in the FIG. 5 size, the filters in this length hood can be standard 12×20 size. The plates in any given installation are preferably of the same width so that, if not hinged, there is no need to keep them sorted for location when reinstalled after removal for access to the filters.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A kitchen exhaust apparatus comprising:

a hood having front, rear and side walls, and a top joined to said walls, and an air outlet for connection to exhaust air mover means to move air from inside said hood through said outlet and air mover means, said front wall having a lower edge;

grease filter means mounted in the hood upstream of said outlet to remove grease from air that has entered the hood, before that air is moved out of the hood through said outlet;

a plate in said hood upstream of said filter means, said plate having a lower edge supported adjacent said rear wall, and an upper front edge supported near said front wall, said plate extending upwardly and forwardly from said lower edge to said upper front edge;

said plate being positioned to provide a slot between said upper front edge and said front wall to accelerate air adjacent said lower edge of said front wall as the air enters a space between said plate and said grease filter means.

2. The apparatus of claim 1 wherein:

said slot is less than four inches above the lower edge of the front wall of the hood.

3. The apparatus of claim 1 wherein:

said plate has first and second adjoining portions, said first portion being inclined upward and forward from said rear edge, and said second portion being inclined upward and forward toward said front edge, the incline of said first portion being steeper than the incline of said second portion.

4. The apparatus of claim 3 wherein:

said plate has two pairs of slots therein, the first pair being adjacent one side edge of said plate and the other pair being adjacent the other side edge of said plate, one slot of each pair being in the first portion of said plate and the other slot of each pair being in the other portion of said plate.

5. The apparatus of claim 4 and further comprising:

a second plate substantially like said first plate and beside said first plate and positioned like said first plate to provide a slot between the front edge of said second plate and the front wall of said hood and which cooperates with the slot between the front edge of the first-mentioned plate and the front wall of the hood to provide a substantially continuous slot the full length of the hood.

6. The apparatus of claim 4 wherein:

said plate has a fifth slot in said first portion thereof and substantially centered between said side edges of said plate.

7. The apparatus of claim 6 wherein:

the slots in said first portion are parallel to the side edges and about 1 inch wide and about 3.75 inches long, and the slots in said intermediate portion are parallel to the side edges and are about 1 inch wide and about 5.62 inches long.

8. The apparatus of claim 3 wherein:

said plate has a horizontally extending slot in said first portion thereof.

9. The apparatus of claim 8 and further comprising:

an exhaust flue on a cooking unit under said hood, said slot being located between side edges of said plate in a way corresponding to the location of the exhaust flue relative to side edges of the cooking unit.

10. The method of removing fumes from the area above a processing apparatus in a building room and comprising the steps of:

placing a hood assembly above the apparatus, with a front wall of the hood assembly generally above the front of the apparatus;

establishing an exhaust flow of air from the room through hood assembly to the outside of the building at a rate less than 150 cubic feet per minute per foot of length of the hood front wall;

preventing the rolling of fumes outward from under the front of the hood assembly into the room by accelerating the exhaust air flow immediately adjacent a lower front edge of the hood assembly through a slot inside the assembly.

11. The method of claim 10 wherein:

the exhaust flow is accelerated at opposite ends of the hood assembly through slots inside the hood assembly located immediately inside the end walls of the hood assembly, the flow rate through the slot at the front and the slots at the ends being at substantially the same lineal velocity, the velocity being reduced in the hood assembly at locations downstream of the slots, upstream of grease filters in the hood assembly.

12. The method of claim 11 wherein the lineal velocity of the exhaust air flow in the slots at the front and the ends is about 400 feet per minute.

13. The method of claim 10 wherein:
the exhaust flow rate is established at less than 125 cubic feet per minute.

14. The method of claim 10 wherein:
the exhaust air flow inward into the hood at the lower front edge of the hood is established at an average velocity of about 200 feet per minute.

15. The method of claim 14 wherein:
all make-up air is provided otherwise than through the hood.

16. The method of claim 10 wherein:
air moving above the processing apparatus is baffled toward said lower front edge of the hood.

17. The method of claim 16 wherein:
said exhaust air is grease-filtered in the hood after passing through said slot.

18. The method of claim 17 wherein:
a portion of the air moving above the processing apparatus is intercepted before reaching said slot and is passed directly through grease filter means.

19. The method of claim 18 wherein:
said intercepted portion of air is diverted through additional slots adjacent the location of the baffling.

20. The method of claim 18 wherein:
the interception of air is adjacent side walls of the hood.

21. The method of claim 19 wherein:
the interception of air is also done approximately midway between side walls of the hood.

22. The method of claim 19 wherein:
the interception of air is done also adjacent side edges of laterally adjacent baffles, whereby excessive heat build-up and resulting puffing, are avoided.

23. At a building having a room having a vertical wall, a kitchen exhaust apparatus comprising:
a hood in the room and having front, rear and end walls, and a top joined to said hood walls, and an air outlet for connection to exhaust air handling blower means to move air from inside said hood through said outlet and blower means, said front wall having a lower edge;
means for mounting filters in said hood in front of said rear wall;
grease filter means mounted on said mounting means in the hood upstream of said outlet to remove grease from air that has entered the hood, before that air is moved out of the hood through said outlet;
flow guide plate means for guiding air under the hood and located in said hood upstream of said filter means, said plate means having a lower edge located at said mounting means below said filter means, and said plate means having an upper front edge located near said front wall, said plate means extending upwardly and forwardly from said lower edge to said upper front edge;
said plate means being positioned to provide a slot between said upper front edge and said front wall to accelerate air adjacent said lower edge of said front wall as the air enters a deceleration space in the hood between said plate means and said grease filter means.

24. The apparatus of claim 23 wherein:
said front wall is the outside wall of said hood, and
said slot is less than four inches above the lower edge of the front wall of the hood.

25. The apparatus of claim 23 wherein:
said plate means have first and second adjoining portions, said first portion being inclined upward and forward from said rear edge, and said second portion being inclined upward and forward toward said front edge, the incline of said first portion being steeper than the incline of said second portion.

26. The apparatus of claim 23 wherein:
a slot is provided between the said end wall and the plate means adjacent said end wall at each end of the hood.

27. The apparatus of claim 26 and further comprising:
air handling blower means coupled to said hood outlet downstream of said filter means and moving air through said slots at a velocity of about 400 lineal feet per minute at the slots.

28. The apparatus of claim 26 wherein:
the width of said slots is substantially uniform.

29. The apparatus of claim 28 wherein the width of said slots is between three and four inches.

30. The apparatus of claim 26 wherein said plate means include:
guide plates substantially like each other and located side by side to cooperate with each other and with said filter means and end walls of said hood to define said deceleration space in said hood upstream of said filter means, two said plates adjacent the opposite end walls being spaced from the end walls to provide said slot at each end wall, the front margins of said plates cooperating with each other and with the front wall of the hood to provide a substantially continuous slot the full length of the hood, whereby the plate means cooperate with the hood front and end walls to provide a peninsular slot for acceleration of the exhaust air flow therethrough from under the plate means into said deceleration space along the front and ends of said hood.

31. The apparatus of claim 29 wherein:
said plates are substantially identical to each other.

* * * * *